US007990078B2

(12) United States Patent
Petrucci et al.

(10) Patent No.: US 7,990,078 B2
(45) Date of Patent: Aug. 2, 2011

(54) LIGHTING CONTROL SYSTEM HAVING A TRIM CIRCUIT

(75) Inventors: James A. Petrucci, Chesterland, OH (US); Terry A. Drabinski, Stow, OH (US); David A. Hite, Wetumpka, AL (US); Sheari A. Rice, Richmond Heights, OH (US)

(73) Assignee: American Sterilizer Company, Mentor, OH (US)

( * ) Notice: Subject to any disclaimer, the term of this patent is extended or adjusted under 35 U.S.C. 154(b) by 0 days.

(21) Appl. No.: 12/716,316

(22) Filed: Mar. 3, 2010

(65) Prior Publication Data

US 2010/0156304 A1 Jun. 24, 2010

Related U.S. Application Data

(62) Division of application No. 11/875,083, filed on Oct. 19, 2007, now Pat. No. 7,701,151.

(51) Int. Cl.
*G05F 1/00* (2006.01)

(52) U.S. Cl. ..... 315/309; 315/247; 315/291; 315/185 S; 315/312

(58) Field of Classification Search ..... 315/291, 315/307–326, 247, 224, 225, 185 S
See application file for complete search history.

(56) References Cited

U.S. PATENT DOCUMENTS

| | | | | |
|---|---|---|---|---|
| 4,962,687 | A | 10/1990 | Belliveau et al. | 84/464 |
| 5,073,838 | A | 12/1991 | Ames | 361/103 |
| 5,078,039 | A | 1/1992 | Tulk et al. | 84/464 |
| 5,325,383 | A | 6/1994 | Davis et al. | 372/26 |
| 6,016,038 | A | 1/2000 | Mueller et al. | 315/291 |
| 6,095,661 | A | 8/2000 | Lebens et al. | 362/184 |
| 6,150,774 | A | 11/2000 | Mueller et al. | 315/291 |
| 6,222,172 | B1 | 4/2001 | Fossum et al. | 250/205 |
| 6,329,764 | B1 | 12/2001 | van de Ven | 315/291 |
| 6,340,868 | B1 | 1/2002 | Lys et al. | 315/185 |
| 6,351,079 | B1 | 2/2002 | Willis | 315/200 |
| 6,362,578 | B1 | 3/2002 | Swanson et al. | 315/307 |
| 6,381,551 | B1 | 4/2002 | Raiser | 702/107 |
| 6,392,358 | B1 | 5/2002 | Runau et al. | 315/185 |
| 6,414,860 | B1 | 7/2002 | Li | 363/49 |
| 6,510,995 | B2 | 1/2003 | Muthu et al. | 235/454 |

(Continued)

FOREIGN PATENT DOCUMENTS

| | | |
|---|---|---|
| JP | 58-182562 | 10/1983 |

(Continued)

OTHER PUBLICATIONS

Bozkurt et al., "Safety Assessment of Near Infrared Light Emitting Diodes for Diffuse Optical Measurements," *BioMedical Engineering Online,* PMC406415, Mar. 22, 2004, see Methods section, http://www.pubmedcentral.nih.gov/picrender.fcgi?artid=406415&blobtype=pdf.

(Continued)

*Primary Examiner* — Tuyet Thi Vo
(74) *Attorney, Agent, or Firm* — Kusner & Jaffe; Michael A. Centanni

(57) ABSTRACT

A lighting control system suitable for a surgical lighting device. The lighting control system includes circuitry that compensates for the effects of temperature changes in a lighting device, and that compensates for forward voltage variations among LED lighting modules to provide substantially uniform light output.

8 Claims, 3 Drawing Sheets

U.S. PATENT DOCUMENTS

| | | | | |
|---|---|---|---|---|
| 6,548,967 | B1 | 4/2003 | Dowling et al. | 315/318 |
| 6,608,452 | B1 | 8/2003 | Holmes | 315/307 |
| 6,621,613 | B2 | 9/2003 | Silberberg et al. | 359/239 |
| 6,717,373 | B2 | 4/2004 | Cash | 315/291 |
| 6,806,659 | B1 | 10/2004 | Mueller et al. | 315/295 |
| 6,808,287 | B2 | 10/2004 | Lebens et al. | 362/184 |
| 6,836,081 | B2 | 12/2004 | Swanson et al. | 315/307 |
| 6,841,947 | B2 | 1/2005 | Berg-johansen | 315/169.3 |
| 6,870,325 | B2 | 3/2005 | Bushell et al. | 315/224 |
| 6,888,529 | B2 * | 5/2005 | Bruning et al. | 345/102 |
| 6,930,452 | B2 | 8/2005 | De Krijger et al. | 315/192 |
| 6,963,175 | B2 | 11/2005 | Archenhold et al. | 315/291 |
| 6,967,448 | B2 | 11/2005 | Morgan et al. | 315/295 |
| 6,987,787 | B1 | 1/2006 | Mick | 372/29.021 |
| 6,989,520 | B2 | 1/2006 | Mochiduki et al. | 250/205 |
| 7,014,336 | B1 | 3/2006 | Ducharme et al. | 362/231 |
| 7,015,825 | B2 | 3/2006 | Callahan | 340/815.45 |
| 7,023,147 | B2 | 4/2006 | Colby et al. | 315/291 |
| 7,045,974 | B2 | 5/2006 | Lin et al. | 315/308 |
| 7,049,758 | B2 | 5/2006 | Weyhrauch et al. | 315/209 |
| 7,053,562 | B2 | 5/2006 | Weyhrauch et al. | 315/209 |
| 7,067,995 | B2 | 6/2006 | Gunter et al. | 315/312 |
| 7,088,059 | B2 | 8/2006 | McKinney et al. | 315/291 |
| 7,106,036 | B1 | 9/2006 | Collins | 323/382 |
| 7,116,062 | B2 | 10/2006 | Weyhrauch et al. | 315/209 |
| 7,145,295 | B1 | 12/2006 | Lee et al. | 315/291 |
| 7,196,481 | B2 | 3/2007 | Bushell et al. | 315/291 |
| 7,321,385 | B2 | 1/2008 | Rus et al. | 348/69 |
| 2002/0190666 | A1 | 12/2002 | Sakamoto et al. | 315/291 |
| 2005/0099824 | A1 | 5/2005 | Dowling et al. | 362/572 |
| 2006/0202914 | A1 | 9/2006 | Ashdown | 345/46 |
| 2006/0273741 | A1 | 12/2006 | Stalker, III | 315/291 |
| 2008/0001061 | A1 | 1/2008 | Glassner et al. | 250/206 |
| 2008/0116827 | A1 | 5/2008 | Williams | 315/360 |

FOREIGN PATENT DOCUMENTS

| | | |
|---|---|---|
| JP | 11-298044 | 10/1999 |
| WO | WO 2008/103032 | 8/2008 |

OTHER PUBLICATIONS

Brukilacchio et al., "Beyond the Limitations of Today's LED Packages: Optimizing Brightness LED Performance by a Comprehensive Systems Design Approach," Mar. 11, 2006 (site last updated Oct. 15, 2006 (from Internet Archive Wayback Machine)), http://www.innovationsinoptics.com/technology/IOI_Technology_Overview.pdf.

"High Efficiency 10 LED Boost Converter," Catalyst Semiconductor, Inc., Revision C, Issued Oct. 17, 2007, http://www.zlgmcu.com/catalyst/LED/CAT4238.pdf.

* cited by examiner

LIGHTING CONTROL SYSTEM HAVING A TRIM CIRCUIT

RELATED APPLICATIONS

This application is a divisional of U.S. application Ser. No. 11/875,083, filed Oct. 19, 2007, now U.S. Pat. No. 7,701,151 and is hereby fully incorporated herein by reference.

FIELD OF THE INVENTION

The present invention relates generally to lighting control, and more particularly to a lighting control system suitable for a surgical lighting device.

BACKGROUND OF THE INVENTION

Many drawbacks have been identified in existing lighting control systems that can result in less than desired performance of a lighting device. These drawbacks include, but are not limited to, voltage variations among LED lighting modules that result in non-uniform light output. These voltage variations may result from the lack of uniformity in the manufacture of the LEDs used in a lighting device. Another drawback of existing lighting control systems is the inability of the lighting circuitry to compensate for the effects of temperature changes on the LED forward voltages, such as changes required in the drive voltage caused by an increase in temperature. In this regard, existing lighting control systems do not compensate for inherent forward voltage changes as seen by an output driver over the entire operating temperature range of the lighting device. The foregoing drawbacks are particularly disadvantageous where the lighting device is a surgical lighthead that requires constant light output or lux readings.

The present invention addresses these and other drawbacks to provide an improved lighting control system for a lighting device.

SUMMARY OF THE INVENTION

In accordance with the present invention, there is provided a lighting control system for a lighting device, the system comprising: a primary controller; a plurality of drive controllers electrically connected with the primary controller; a plurality of drive outputs electrically connected with a drive controller, each drive controller controlling at least one drive output; a plurality of LED modules, each LED module electrically connected with a drive output and having a plurality of LEDs.

An advantage of the present invention is the provision of a lighting control system that compensates for the effects of temperature changes on the forward voltages of LEDs within a lighting device.

Another advantage of the present invention is the provision of a lighting control system that compensates for voltage variations among individual LED lighting modules to provide substantially uniform light output.

These and other advantages will become apparent from the following description taken together with the accompanying drawings and the appended claims.

BRIEF DESCRIPTION OF THE DRAWINGS

The invention may take physical form in certain parts and arrangement of parts, an embodiment of which will be described in detail in the specification and illustrated in the accompanying drawings which form a part hereof, and wherein.

DETAILED DESCRIPTION OF THE INVENTION

Figure 1:
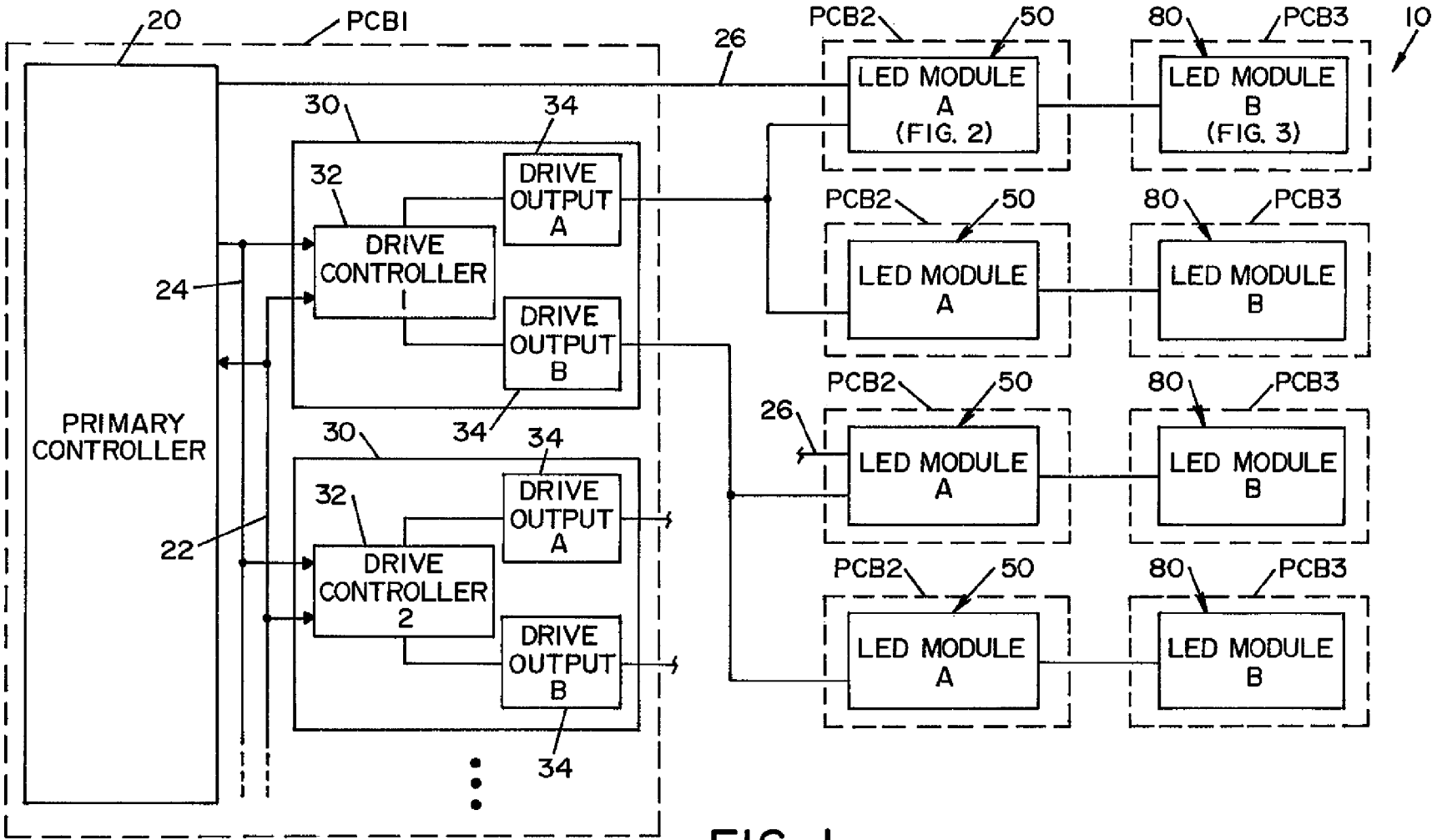
FIG. 1 is a general block diagram of a lighting control system for a lighting device, in accordance with an embodiment of the present invention.

Referring now to the drawings wherein the showings are for the purposes of illustrating an embodiment of the invention only and not for the purposes of limiting same, FIG. 1 shows a block diagram of lighting control system 10 for a lighting device, such as a surgical lighthead, in accordance with an embodiment of the present invention. Lighting control system 10 is generally comprised of a primary controller 20, drive circuitry 30 comprised of at least one drive controller 32 and at least one drive output 34, one or more first LED modules 50 (module A), and one or more second LED modules 80 (module B). In the illustrated embodiment, primary controller 20 and drive circuitry 30 are located on a first printed circuit board PCB1. Each of the first and second LED modules 50 and 80 are respectively located on second and third printed circuit boards PCB2 and PCB3. Printed circuit boards PCB1, PCB2 and PCB3 may be located together within a housing (not shown) for the lighting device. It should be appreciated that in an alternative embodiment, the components of LED modules 50 and 80 residing separately on printed circuit boards PCB2 and PCB3 may be located together on a single substrate (i.e., printed circuit board).

In the illustrated embodiment, primary controller 20 is a microcontroller. For example, primary controller 20 may take the form of an ARM-based processor with a variety of on-chip peripherals, including, but not limited to, an internal FLASH memory for program storage, a RAM memory for data storage, UARTs, timer/counters, a bus interface, a serial interface, an SPI interface, a programmable watchdog timer, programmable I/O lines, an A/D converter and PWM outputs. Primary controller 20 sends commands to drive controllers 32 and reads status information from each drive controller 32.

It should be understood that primary controller 20 may also communicate with other electronic devices not illustrated in FIG. 1, including, but not limited to, a user interface (e.g., front panel display with keypad, control switches or buttons), a communications interface, a video input connector, and a camera module. The user interface allows a user to turn ON/OFF the lighting device and select an intensity level for the lighting device. It can also allow the user to turn ON/OFF other accessories configured with the lighting system.

Primary controller 20 communicates with drive controllers 32 via a bus 22. In the illustrated embodiment, bus 22 is a serial bus (e.g., $I^2C$). Primary controller also provides a constant clock signal to drive controllers 32 via a synch line 24, as will be explained in further detail below.

In the illustrated embodiment, drive controller 32 is a microcontroller. For example, each drive controller 32 may take the form of an ARM microcontroller with a variety of on-chip peripherals, including, but not limited to, an internal FLASH memory for program storage, a RAM memory for data storage, timer/counters, a serial interface, an A/D converter, a programmable watchdog timer, and programmable I/O lines. In the illustrated embodiment, each drive controller 32 has a unique identification number that allows primary controller 20 to individually address each drive controller 32.

Figure 2:
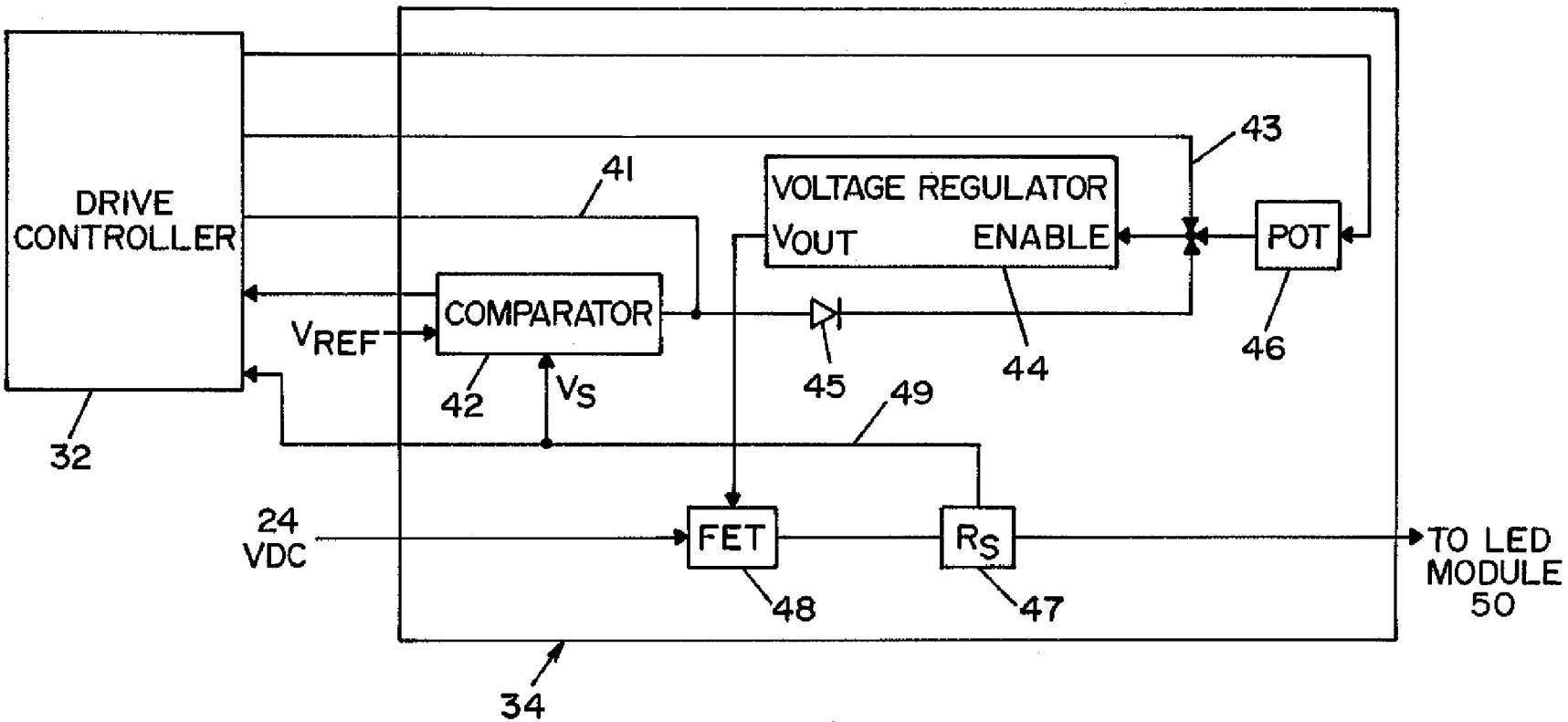
FIG. 2 is a schematic view of a drive output circuit, in accordance with an embodiment of the present invention.

Referring now to FIG. 2, each drive output 34 is a circuit generally comprising a comparator 42 (e.g., LMV7235 from National Semiconductor), a voltage regulator, a diode 45, a setpoint potentiometer (POT) 46, a power field effect transistor (FET) 48, and a feedback resistor ($R_S$) 47. Drive outputs 34 are driven (i.e., enabled) at a fixed frequency (i.e., fixed frequency enable signal provided via line 43). In the illustrated embodiment, drive outputs 34 are driven with an enable signal having a fixed frequency of 300 Hz.

Voltage regulator 44 provides an accurate fixed output voltage (e.g., 5V) when enabled. The output voltage (Vout) of voltage regulator 44 is electrically connected with power FET 48. FET 48 is used to handle the current required by LED modules 50, 80. Sense resistor ($R_S$) 47 provides current sensing. Setpoint POT 46 is used to adjust the output voltage of voltage regulator 44 until the sensed current associated with $R_S$ 47 is within a target current range.

Comparator 42 monitors the output voltage of a drive output 34. In this respect, comparator 42 receives a reference voltage ($V_{REF}$) as a first input and receives a sensed voltage ($V_S$) as a second input via line 49. Comparator 42 compares $V_{REF}$ to $V_S$ to determine whether the sensed current (Is) associated with $V_S$ exceeds a threshold current (e.g., approximately 1.26 A). If the threshold current has been exceeded, then comparator 42 outputs a signal to disable voltage regulator 44, thereby turning off $V_{OUT}$ of voltage regulator 44. Drive controller 32 may also disable voltage regulator 44 under certain conditions (e.g., detection of an open or short circuit fault).

Figure 3:
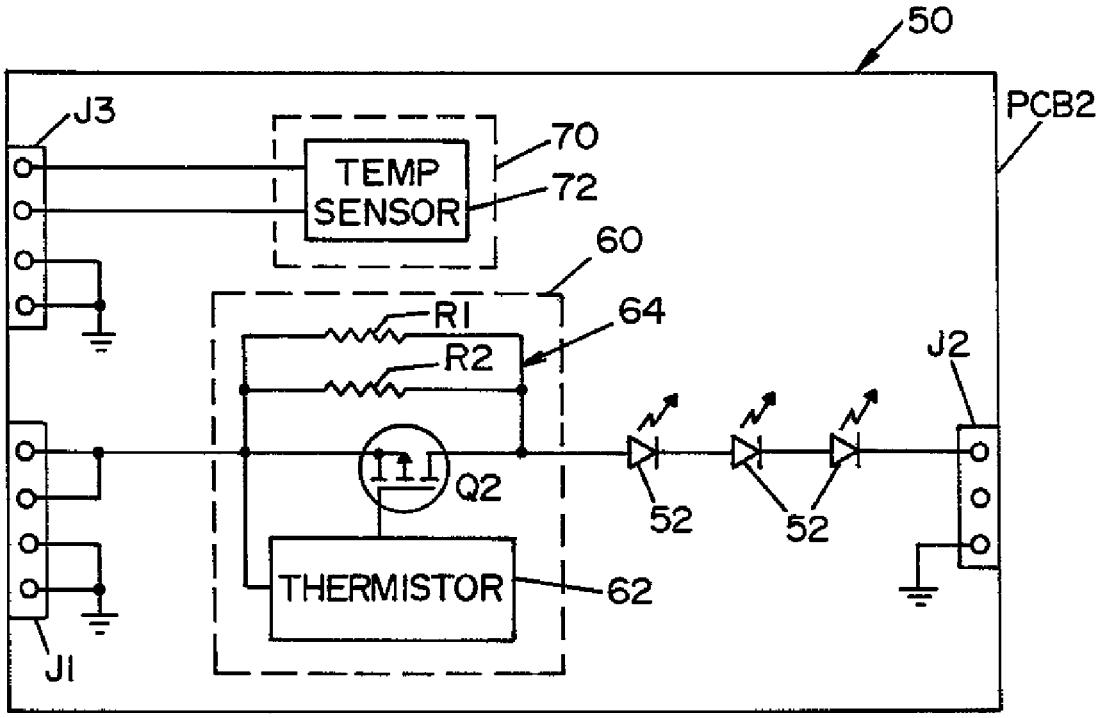
FIG. 3 is a schematic view of a first LED module including a temperature compensation circuit, in accordance with an embodiment of the present invention.
Figure 4:
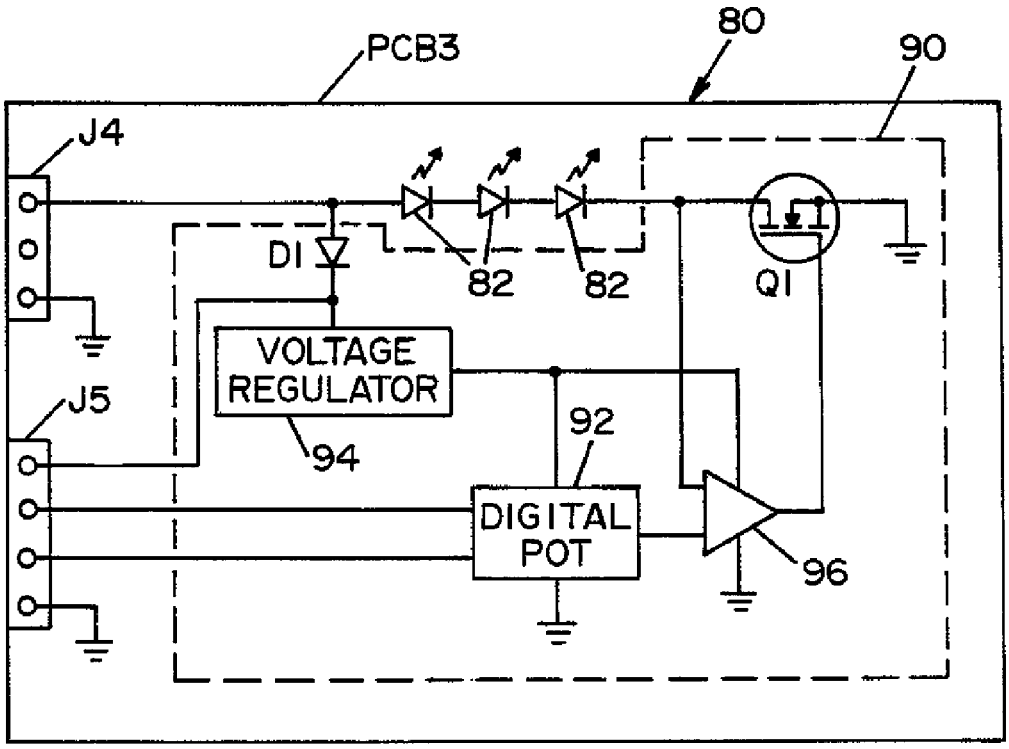
FIG. 4 is a schematic view of a second LED module including a trim circuit, in accordance with an embodiment of the present invention.

FIGS. 3 and 4 respectively show schematic views of LED module 50 (module A) and LED module 80 (module B). In the illustrated embodiment, LED modules 50 and 80 are electrically connected in series by a wire harness assembly connected between connector J2 of LED module 50 and connector J4 of LED module 80. Accordingly, each pair of series-connected LED modules 50, 80 collectively provide a set of six (6) series-connected LEDs. A first series-connected pair of LED modules 50, 80 may be wired in parallel with a second series-connected pair of LED modules 50, 80. The first and second series-connected pairs of LED modules 50, 80 are driven from a single drive output 34 (i.e., drive output channel). Each LED module 50 is electrically connected with a drive output 34 via a wire harness assembly (not shown) connected at connector J1. In the illustrated embodiment, two pair of LED modules 50, 80 are electrically connected with drive output A and two pair of LED modules 50, 80 are electrically connected with drive output B.

Referring now to FIG. 3, LED module 50 includes a plurality of LEDs 52, a temperature compensation circuit 60 and an optional remote temperature sensor circuit 70. In the illustrated embodiment, LED module 50 includes three (3) series-connected LEDs 52 (e.g., high brightness LEDs). Temperature compensation circuit 60 compensates for changes in the forward voltage required to drive LEDs due to increased temperatures. As LED temperatures increase, the forward voltage must be reduced in order to maintain constant drive current to the LEDs. Temperature compensation circuit 60 includes a field effect transistor (FET) Q2, a thermistor 62, and a resistor network 64 comprised of resistors R1 and R2. Power is provided to temperature compensation circuit 60 via connector J1. Thermistor 62 is a temperature sensing resistive device. FET Q2 balances (i.e., equalizes) resistor network 64 by turning on more (or less) to throttle the current.

Remote temperature sensor circuit 70 includes a temperature sensor 72 (e.g., TMP35 low voltage temperature sensor from Analog Devices) to provide primary controller 20 with temperature data for monitoring the temperature in the vicinity of printed circuit board PCB2. Temperature sensor 72 provides a voltage output that is linearly proportional to the sensed temperature. Temperature sensor circuit 70 is electrically connected to primary controller 20 via connector J3 and line 26. Primary controller 20 receives the output of temperature sensor circuit 70. Primary controller 20 may read a limited number of temperature sensor inputs from printed circuit boards PCB2. In the illustrated embodiment, only two temperature sensor circuits 70 on LED modules 50 are selected or connected to primary controller 20.

Referring now to FIG. 4, LED module 80 includes a plurality of LEDs 82 and a trim circuit 90. In the illustrated embodiment, LED module 80 includes three (3) series-connected LEDs 82 (e.g., high brightness LEDs).

Trim circuit 90 compensates for differences in forward voltage values between LEDs due to non-uniformity in the manufacture of LEDs. In this respect, trim circuit 90 balances the voltage drop differences across the series-connected LEDs 52, 82 to insure that the appropriate voltage is applied across the series-connected LEDs 52, 82 to set the desired forward current value and make all LED modules 50, 80 appear identical (i.e., uniform lighting). Trim circuit 90 includes an adjustable FET Q1 controlled by an amplifier (comparator) 96 (e.g., AD8220 JFET input instrumentation amplifier from Analog Devices) that provides a means whereby the paired LED modules 50, 80 can be calibrated (i.e., "trimmed") to a fixed voltage drop across the module pair as described below. A digital potentiometer (POT) 92 (e.g., MAX 5417 a digital potentiometer from Maxim Integrated Products) is used to fix the gate voltage to FET Q1. A micro-power voltage regulator 94 (e.g., LM4040 voltage reference from Maxim Integrated Products) is used to power amplifier 96 and digital POT 92. Voltage regulator 94 provides 5V for digital POT 92, amplifier 96 and bias circuits (not shown). The input to voltage regulator 94 uses a blocking diode D1 and two capacitors (not shown). The combination of diode D1 and the two capacitors provides a small capacitive storage between pulses to maintain constant voltage under the minimum duty cycle at the normal operating frequency (e.g., 25% at 300 Hz). Voltage regulator 94 is always powered once voltage is applied to LEDs 52, 82.

Operation of lighting control system 10 will now be described in detail. Primary controller 20 is programmed to provide overall control of lighting control system 10. In this respect, primary controller 20 communicates with drive controllers 32, as well as other system components, such as a user interface, and a video camera.

In the illustrated embodiment, primary controller 20 supplies a 30 KHz drive clock signal, via synch line 24, to each drive controller 32. The drive clock signal is used to maintain synchronization among drive controllers 32 and provide each drive controller 32 with a fixed time base used to drive respective LED modules 50, 80. In this regard, the drive clock signal directly drives two internal timers within each drive controller 32. The first internal timer of each drive controller 32 is associated with a first drive output 34 (drive output A) and the second internal timer of each drive controller 32 is associated with a second drive output 34 (drive output B). The internal timers allow the two drive outputs 34 (i.e., drive output A and drive output B) to provide drive output signals that are out of phase with each other, thereby preventing large fluctuations in current consumption when the lighting device is activated. In accordance with a preferred embodiment of the present invention the phase is different for each drive output 34 of all drive controllers 32. Thus, drive output A of drive controller 1, drive output B of drive controller 1, drive output A of drive controller 2 and drive output B of drive controller 2 all provide drive output signals that are out of phase with each other.

The drive output signals associated with drive outputs 34 preferably have a fixed frequency of 300 Hz, which is a multiple of 50 Hz (the scan rate of PAL video cameras) and 60 Hz (the scan rate of NTSC video cameras). When using an optional video camera with the lighting device associated with the present invention, the camera will detect a noticeable flicker in the light if the output frequency of LEDs 52, 82 is not a multiple of the camera scan rate.

Primary controller 20 sends multiple commands to each drive controller 32 in order to "activate" LED modules 50, 80 (i.e., turn on LEDs 52, 82). The commands include a command indicative of a "target duty cycle," a command indicative of the "phase offset" for each drive output 34, and a command indicative of activation of LED modules 50, 80, referred to as a "start" command. The target duty cycle is indicated by units of the primary controller's drive clock periods (i.e., the number of drive clock periods to turn ON). The drive clock periods are fixed-duration clock pulses counted by the internal timers of each drive controller 32 to determine how long to turn ON respective drive outputs 34 during each period of the drive output signal. As indicated above, the drive output signals preferably have a fixed frequency of 300 Hz, and thus have a period of 3.33 msec. A phase offset is generated in units of the primary controller's drive clock periods. The start command indicates to drive controllers 32 that the associated LED modules 50, 80 are about to be activated (i.e., turn on LED lights). Drive controllers 32 use the start command to initialize their respective internal timers and prepare for commencement of the drive clock signal generated by primary controller 20. Primary controller 20 may also send a "stop" command to drive controllers 32 in order to inform drive controllers 32 to turn off associated drive outputs 34 and stop their respective internal timers.

The drive clock signal of primary controller 20 drives the two internal timers within each drive controller 32, thereby allowing drive controllers 32 to control associated LED modules 50, 80 at the target duty cycle, via drive outputs 34. The values for various target duty cycles provided by primary controller 20 are established to correspond to a plurality of predetermined, user selectable LED intensity levels. By way of example, and not limitation, the illustrated embodiment may include the following nine fixed intensity levels:

| Intensity Level | Duty Cycle |
|---|---|
| 1 | 40% |
| 2 | 50% |
| 3 | 60% |
| 4 | 70% |
| 5 | 80% |
| 6 | 90% |
| 7 | 100% |
| Maintenance | 25% |
| Calibration | 100% |

The target duty cycle is generated from the number of fixed clock pulses counted (e.g. 40% duty cycle requires a count of 40 clock pulses) within the period of the 300 Hz drive output signal. The predefined, fixed duty cycle values associated with each intensity level may be stored in a lookup table in the memory of primary controller 20.

The maintenance intensity level provides a low duty cycle in order to obtain low light intensity to facilitate inspection for failed LED modules 50, 80 with reduced eye discomfort. The calibration intensity level provides a maximum duty cycle that allows convenient adjustment of power supplies until the lowest drive current output is at the target drive current, thereby delivering sufficient drive output current to all of the LED modules 50, 80.

As indicated above, the drive output signal of drive outputs 34 have a fixed frequency. Preferably, the fixed frequency is 300 Hz ($T_{period}$=3.33 msec). Therefore, for a selected intensity level, the drive output signal of each drive output 34 will be turned ON for a predefined, fixed number of clock cycles of the primary controller's drive clock and turned OFF for a predefined, fixed number of clock cycles of the drive clock of primary controller 20.

Operation of LED module 50 (module A) will now be described in detail with reference to FIG. 3. Temperature compensation circuit 60 adjusts the total voltage drop across the LED module pairs 50, 80, as the forward voltage characteristics of LEDs 52, 82 changes with LED temperature. As LEDs 52, 82 heat up, their forward voltage drops. Reductions in forward voltage leads to an increase of current flowing through LEDs 52, 82. The total voltage drop across the six series-connected LEDs 52, 82 of LED modules 50, 80, is high enough to require some form of temperature compensation to maintain the LED drive current at the target drive current and to prevent the LED modules 50, 80 from going into overcurrent shutdown.

Temperature compensation circuit 60 of LED module 50 (i.e., LED module A) includes a FET Q2 that is biased such that when LED modules 50, 80 are cold, FET Q2 is fully on. This results in the forward resistance of FET Q2 being very low so there is a relatively small amount of voltage dropped across FET Q2 when cold. As LED modules 50, 80 begin to heat up, thermistor 62 acts to reduce the gate voltage on FET Q2 and increases its forward resistance. This action effectively absorbs the reduction of forward voltage as LEDs 52, 82 heats up. As the LEDs 52, 82, begins to heat up, thermistor 62 in the FET Q2 bias network acts to reduce the gate voltage on the FET Q2 and increases its forward resistance. This action effectively absorbs the reduction of forward voltage as LEDs 52, 82 heat up. As the resistance of thermistor 62 gets increasingly lower, the gate voltage to the FET Q2 gets low enough so that the resistance of FET Q2 is much higher than that of the pair of parallel low value power resistors R1, R2. At this point, virtually all of the current flowing through the temperature compensation circuit 60 passes through parallel resistors, R1, R2, effectively switching out FET Q2. Switching out FET Q2 and switching in fixed resistors, R1, R2, allows FET Q2 to be smaller and less expensive since FET Q2 does not need to be rated to handle the total current at higher temperatures. Temperature compensation circuit 60 is a stand alone circuit that has no feedback to drive controller 32 or primary controller 20.

As indicated above, temperature sensor circuit 70 provides data to primary controller 20 for display only and is indicative of the operating temperature in the vicinity of LED module 50.

Operation of LED module 80 (module B) will now be described in detail with reference to FIG. 4. Trim circuit 90 of LED module 80 provides the ability of inserting an adjustable fixed voltage drop in series with the six LEDs, 52, 82 to calibrate the pair of LED modules 50, 80 to a fixed input voltage used to power all LED modules 50, 80 in the lighting device. An adjustable voltage drop in series with LEDs, 52, 82, allows the voltage of each pair of modules 50, 80, to be set to a common voltage at a specified current. This capability allows pairs of modules 50, 80 to be driven in parallel.

Each drive output 34 drives two pairs of LED modules 50, 80 electrically connected in parallel. If the two parallel pairs of LED modules 50, 80 do not have substantially similar forward voltage drops, the currents through the two parallel pairs of LED modules 50, 80 will not be equal, and thus the light output of the two parallel pairs of LED modules 50, 80 will vary accordingly.

Amplifier 96 of trim circuit 90 generates the gate voltage of FET Q1 based on the difference between the positive input from the FET drain and the negative input that is set using digital POT 92. When digital POT 92 is being set to an appropriate resistance value, FET Q1 acts as a fixed resistor in series with LEDs 52, 82. Adjusting the forward resistance of FET Q1 effectively nullifies forward voltage variations of LED modules 50, 80 caused by the different forward voltages of LEDs 52, 82.

POT 92 is adjusted and programmed as part of the LED module manufacturing process by connecting connector J5 to a programming tool (e.g., a test and calibration instrument) that writes a setpoint value to the POT 92. Adjustment of POT 92 is performed during a manufacturing and test process when the LED modules, 50, 80, are electrically connected together. During the manufacturing process of LED modules 50, 80, approximately 24V is applied by a test and calibration instrument to LED module 50 via connector J1. POT 92 is then adjusted such that the drive current through LEDs 52, 82 is a predetermined drive current target value. Trim circuit 90 is a stand alone circuit and has no feedback to drive controller 32 or primary controller 20.

It should be noted that LED modules 50, 80 may be overdriven to account for optical losses during assembly of the lighting device. In this regard, the LED drive current control target is set to a predetermined, fixed offset above the nominal LED forward drive current. Accordingly, manufacturing personnel will be able to increase the intensity of LEDs 52, 82 by adjusting the drive current to a value within the allowable LED manufacturer range, thereby achieving a desired lux reading from the lighting device.

A calibration function is provided by primary controller 20 to allow an additional adjustment to be made to "tune" the drive current closer to the target drive current. Power supplies with adjustable 24VDC output to be supplied to lightheads that include LED modules 50, 80 may have the outputs adjusted up or down to increase or reduce the drive current readings.

Drive controller 32 is programmed to sample the LED drive current, and determine whether the LED drive current is within the target drive current value plus/minus a predefined tolerance to provide fault messages to the display. If the LED drive current is outside the allowable tolerance, an audible or visual alarm indicator may be used to indicate to the user that power supplies need to be adjusted, or LED modules 50, 80 (or associated harnesses) need replacement.

Primary controller 20 is programmed to monitor the LED drive current of drive outputs 34 to determine if one or both of the associated pair of LED modules 50, 80 have failed "opened" (i.e., open circuit) in order to supply a fault message to the display. If one LED module 50, 80 of the LED module pair has failed open, the drive current will be approximately 50% of a target drive current setting. If both LED module pairs have failed, the drive current reading will be approximately 0 mA. The failed conditions are detected by primary controller 20 and indicator alarms are generated at user interfaces.

A portion of each drive output 34 determines whether an LED module 50, 80 has failed due to a short circuit. In this respect, drive output 34 detects the presence of a short circuit and generates an over-current indication to the associated drive controller 32. This drive controller 32 then turns off the drive output 34 associated with the LED module 50, 80 having a short circuit, and prevents the drive output 34 from being turned on until the short circuit fault condition has been cleared. A fault message may be also displayed to a user.

Other modifications and alterations will occur to others upon their reading and understanding of the specification. It should be understood that it is contemplated that the present invention may have many alternative configurations. For example, in one configuration, 28 LED modules are grouped into 14 LED module pairs. Accordingly, four drive controllers are connected with the primary controller. In another configuration, 56 LED modules are grouped into 28 LED module pairs. Accordingly, seven drive controllers are connected with the primary controller. Furthermore, it is contemplated that multiple color LEDs may be substituted for the single color LEDs of the illustrated embodiment. It is intended that all such modifications and alterations be included insofar as they come within the scope of the invention as claimed or the equivalents thereof.

Having described the invention, the following is claimed:

1. A lighting control system for a lighting device, the system comprising:

a primary controller;

a plurality of drive controllers electrically connected with the primary controller;

a plurality of drive outputs electrically connected with a drive controller, each drive controller controlling at least one drive output;

a plurality of LED modules, each LED module electrically connected with a drive output and having a plurality of series-connected LEDs, wherein at least one of said plurality of LED modules include:

a trim circuit to compensate for forward voltage variations among said LEDs of the LED module, said trim circuit balancing voltage drop differences across the series-connected LEDs thereby providing substantially uniform lighting for said plurality of LED modules, wherein said trim circuit includes:

a transistor that effectively nullifies the forward voltage variations among said LEDs of the LED module by adjustment of gate voltage of the transistor, said gate voltage of the transistor generated based on the difference between positive input from the transistor drain and a negative input.

2. A lighting control system according to claim 1, wherein said trim circuit includes a potentiometer to set the negative input.

3. A lighting control system according to claim 1, wherein at least one of said plurality of LED modules includes:

a temperature sensing device for sensing temperature in the vicinity of the LED module.

4. A lighting control system according to claim 1, wherein said primary controller monitors a drive current associated with each drive output in order to determine whether one of said plurality of LED modules has an open circuit failure.

5. A lighting control system according to claim 1, wherein said drive output includes circuitry to determine whether an associated LED module has a short circuit failure.

6. A lighting control system according to claim 1, wherein said primary controller operates in a maintenance mode wherein said plurality of LED modules operate at a low duty cycle.

7. A lighting control system according to claim 1, wherein said primary controller operates in a calibration mode allowing tuning of said plurality of LED modules to a LED drive current within a range from a predetermined target drive current.

8. A lighting control system according to claim 1, wherein said system includes a substrate having a plurality of LED modules located thereon.

* * * * *